United States Patent [19]

Bermier, Jr. et al.

[11] Patent Number: 4,628,599

[45] Date of Patent: Dec. 16, 1986

[54] METHOD FOR STRIPPING INSULATION

[75] Inventors: Frank H. Bermier, Jr., Tempe, Ariz.; Glendon H. Schwalm, Seminole, Fla.; Donald F. Urgo, Tempe, Ariz.; Paul Vinson, Carefree, Ariz.; Darwin D. White, Peoria, Ariz.

[73] Assignee: AMP Incorporated, Harrisburg, Pa.

[21] Appl. No.: 716,772

[22] Filed: Mar. 27, 1985

[51] Int. Cl.[4] ..... H01R 43/00

[52] U.S. Cl. ..... 29/857; 29/861; 81/9.51; 83/925 R; 339/17 F

[58] Field of Search ..... 30/90.6, 90.8; 83/925 R; 81/9.51; 339/17 F; 29/857, 861, 863

[56] References Cited

U.S. PATENT DOCUMENTS

| | | | |
|---|---|---|---|
| 3,530,575 | 9/1970 | Riche | 81/9.51 X |
| 3,895,426 | 7/1975 | Papsdorf | 81/9.51 X |
| 4,120,217 | 10/1978 | Rodd et al. | 81/9.51 |
| 4,387,746 | 6/1983 | Meehan | 81/9.51 X |
| 4,394,828 | 7/1983 | Garbis | 81/9.51 |

FOREIGN PATENT DOCUMENTS

| | | | |
|---|---|---|---|
| 2654766 | 6/1978 | Fed. Rep. of Germany | 81/9.51 |

*Primary Examiner*—Howard N. Goldberg
*Assistant Examiner*—Carl J. Arbes
*Attorney, Agent, or Firm*—Robert W. Pitts; Adrian J. Larue

[57] ABSTRACT

Methods and apparatus for stripping insulation from low profile high performance cable are disclosed. The apparatus includes hand-held tools with an aperture at each end for sequentially slicing or cutting predetermined layers of insulation from the cable at predetermined lengths from the end of the cable being stripped. The methods are for performing these steps whether performed by the tools, by a hand-held knife or by automated machinery.

11 Claims, 14 Drawing Figures

42
64
88
76
86
74
66
70
60
56
64
46
78
88
50
80
44
86
53
66
52
72
76
48
74
62

METHOD FOR STRIPPING INSULATION

BACKGROUND OF THE INVENTION

1. Field of the Invention

This invention relates to methods and apparatus for stripping predetermined lengths of insulating and conductive materials from the ends of a low profile cable to facilitate terminating or coupling of the cable, the cable having the functional characteristics of a shielded twisted pair cable.

2. Description of the Prior Art

Conventional multiconductor cables for transmitting high frequency electrical signals include both shielded twisted pair cables and coaxial cables. Such cables have their greatest utility in transmitting electrical signals between components of electrical systems. Such transmitted signals can be in digital form, although such transmitted signals may also be in analog form.

Shielded twisted pair cables utilize a pair of insulated conductive wires in a twisted pair configuration with a grounded, electrically conductive shield around each twisted wire pair. The shield functions to reduce electromagnetic interference radiation, generally called EMI, which naturally emanates from signal transmitting wires and which might otherwise adversely affect the performance of adjacent electronic devices. Such shield also functions to minimize cross talk, electrical interference between one pair of wires and an adjacent pair which would tend to impair the fidelity of the signals being transmitted. Shielded twisted pair cables can function as a type of a differential transmission system where both wires are electrically powered and both constitute signal carrying wires. The information transmitted is a function of the sequential voltage differential between the two wires of the pair. An example of a shielded twisted pair cable is described in U.S. Pat. No. 4,404,424 issued to King et al.

In a manner similar to shielded twisted pair cables, coaxial cables use an EMI shield to reduce radiation. But in coaxial cables, unlike shielded twisted pair cables, only one electrically powered signal wire is utilized. The signal wire is encased in insulation which is surrounded, in turn, by the grounded, electrically conductive shield. In coaxial cables, the shield also functions as a grounded reference for the voltage of the signal wire. An example of a coaxial cable is described in U.S. Pat. No. 3,775,552 issued to Schumacher.

Considerable effort has been extended to develop a flat coaxial cable which would yield the same performance characteristics as conventional coaxial cable but which would also enable the use of conventional mass stripping and termination techniques to thus facilitate the coupling of an electrical connector to the cable. Consider for example U.S. Pat. No. 4,448,125 to Gentry et al. Other flat coaxial cables are disclosed in U.S. Pat. No. 4,487,992 and 3,775,552.

One application for flat cable is in under the carpet wiring situations in which a flat, low profile cable is extended beneath a carpet for connection to, and coupling of, components of an electrical system such as a computer system or the like. Shielded twisted pair cables do not have a low profile suited for use in undercarpet applications since twisted wires are continuously and sequentially located above, to one side, below, and to the other side of each other along the length of the cable. As a result, the cable thickness periodically increases to a double wire thickness along the length of the cable. This arrangement of signal wires thus precludes low profile cable configurations since low profile cable configurations are possible only in cables having their wires spaced parallel to each other in a single, usually horizontal, plane. The configuration and orientation of wires in a shielded twisted pair cable also precludes mass stripping and termination since the positioning of any one wire with respect to another varies as a function of where the cable is cut along its length.

While many stripping methods and apparatus have been proposed for use with existing types of cables, the instant inventive methods and apparatus are designed for stripping the ends of high performance, low profile cables to render them suitable for termination or coupling to a connector or the like. The invention can be incorporated in hand-held tools which may be utilized in performing such methods. Such methods, however, are suitable for being performed by hand or by automated machinery.

SUMMARY OF THE INVENTION

The instant invention comprises apparatus and methods for stripping insulation from a high frequency electrical signal transmitting cable having at least one pair of associated wires. The apparatus and method can be incorporated into a hand tool. A first insulator surrounds each wire along its length. A second insulator surrounds each associated pair of wires and first insulators, and EMI shields surround the second insulators. A third insulator constituting the cable body surrounds the EMI shields. The body has a longitudinal central region and marginal wings. Both embodiments of the stripping tool comprise an upper half and a lower half secured together at a point intermediate the first end of the tool and the second end of the tool. A first aperture is in the first end of the tool for the receipt of the central region of the cable and a second aperture is in the second end of the tool for the receipt of the second insulator. Longitudinal knife edges are positioned above and below the first aperture normally located a sufficient distance from each other to allow the entry of a predetermined length of the central portion of the cable into the first end without slitting the cable. These knife edges are movable into operative slitting association with each other whereby upon moving the knife edges into such operative association concurrently with the extraction of the cable from the first aperture, the knife edges will longitudinally slit the exterior portions of the third insulator and EMI shield adjacent the exterior portions of the first insulator. Second knife edges are positioned above and below the second aperture normally located a sufficient distance from each other to allow the entry of a predetermined length of the second insulator into the second end without cutting the second insulator. The second knife edges are also movable into operative cutting association with each other whereby upon moving the second knife edges into such operative association with each other they may cut the second insulator but not the first insulator. In the primary embodiment of the invention, the second knife edges include at least one longitudinal upper blade above the second aperture and at least one longitudinal lower blade below the second aperture, the upper and lower blades movable relatively toward each other to slit through the second insulator, but not the first insulators, upon the extraction of the second insulation from the second aperture. In an alternate embodiment, the second knife edges include a pair of transverse blades, one above and one below the second aperture, normally spaced a sufficient distance to allow the introduction of a single second insulator into the second aperture but movable into contact with one another to chop the second insulator but not the first insulator. These knife edges include at least one semicircular cut out section in each blade of a size and position to preclude the cutting of the first insulator. Abutment surfaces within the tool limit the depth of penetration of the central region of the body portion into the first aperture and a second abutment surface within the tool limit the depth of penetration of the second insulator into the second aperture. The two abutment surfaces are located so that the depth of penetration into the first aperture is greater than the depth of penetration into the second aperture. In the alternative, the cutting at the second end of the tool may be eliminated and the second insulator can be torn by an operator by hand. A weakened longitudinal ridge in the second insulator facilitates such tearing. As a result the second, or intermediate, insulator may be separated into two sections along with the two wires for further operations. The present invention also includes the methods as carried out by the above described tools whether carried out by one of such tools, performed by hand or performed by automatic machinery.

BRIEF DESCRIPTION OF THE DRAWINGS

FIGS. 3 through 5 are perspective showings of the cable of FIG. 2 during the stripping of the edges of the EMI shield and the exterior or third insulator from from the cable.

DESCRIPTION OF THE PREFERRED EMBODIMENT

The multilayer shielded pair cable to be stripped in accordance with the teachings of this invention provides a controlled, high impedance, low cross talk, low attenuation multiconductor flat cable suitable for use in transmitting digital or other high frequency signals. The cable will be described in terms of a flat conductor cable having two separate pairs of associated wire conductors, four conductors in all. It should be understood, however, that some applications may require cable having more than just two pairs of conductors. This invention is consistent with the use of stripping any number of pairs of conductors and can be employed with a single pair of conductors or with a large number of pairs. Indeed, this invention is intended for use in applications requiring three or more pairs of conductors or even one pair in a manner similar to the use of the two-pair cable.

Figure 12:
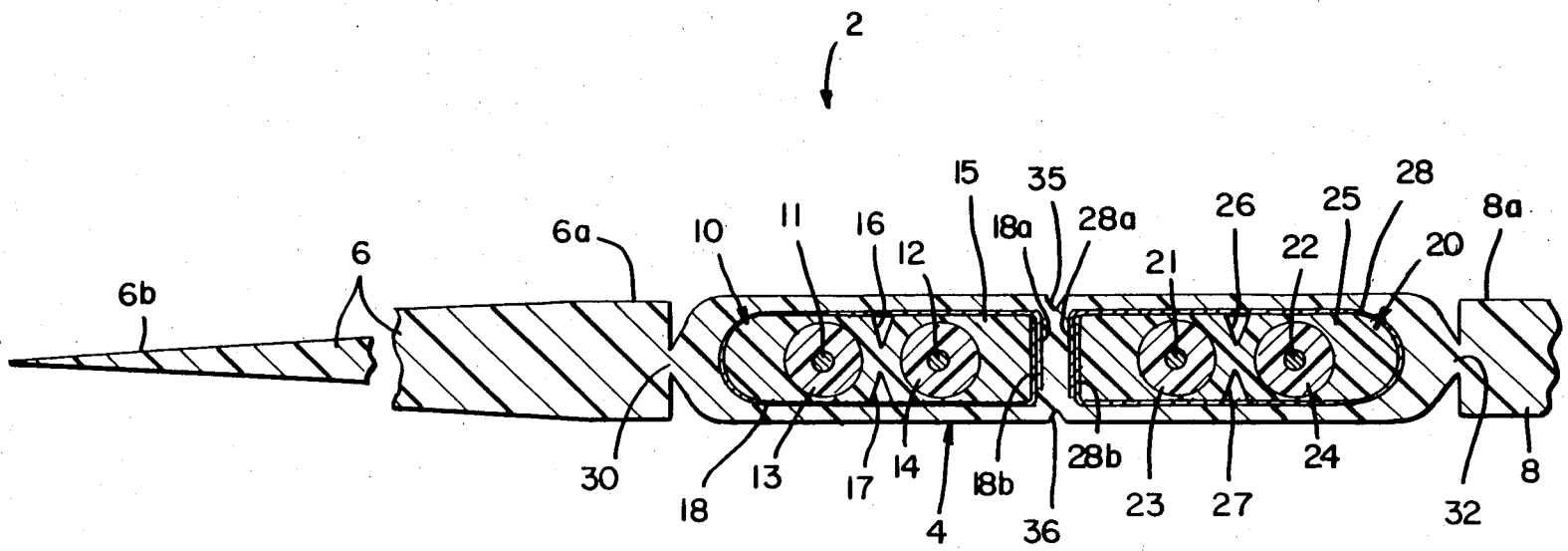
FIG. 12 is a section view of the preferred embodiment of the cable.

As can be seen in the drawings, particularly with reference to FIG. 12, the cable to be stripped is fabricated with a common symmetrical cross-sectional profile along its entire length. By virtue of its weakened sections 30 and 32 it can rest on the floor in a flat condition no matter which side is placed on the floor. With reference again to FIG. 2, both ends of the cable may be stripped for coupling the cable with an adaptor and connector of the type as disclosed in U.S. patent application Ser. No. 716,779, entitled ADAPTOR FOR COUPLING A CABLE TO A CONNECTOR, filed concurrently herewith and assigned to the same assignee as the present application. The subject matter of that application is incorporated by reference herein.

Figure 2:
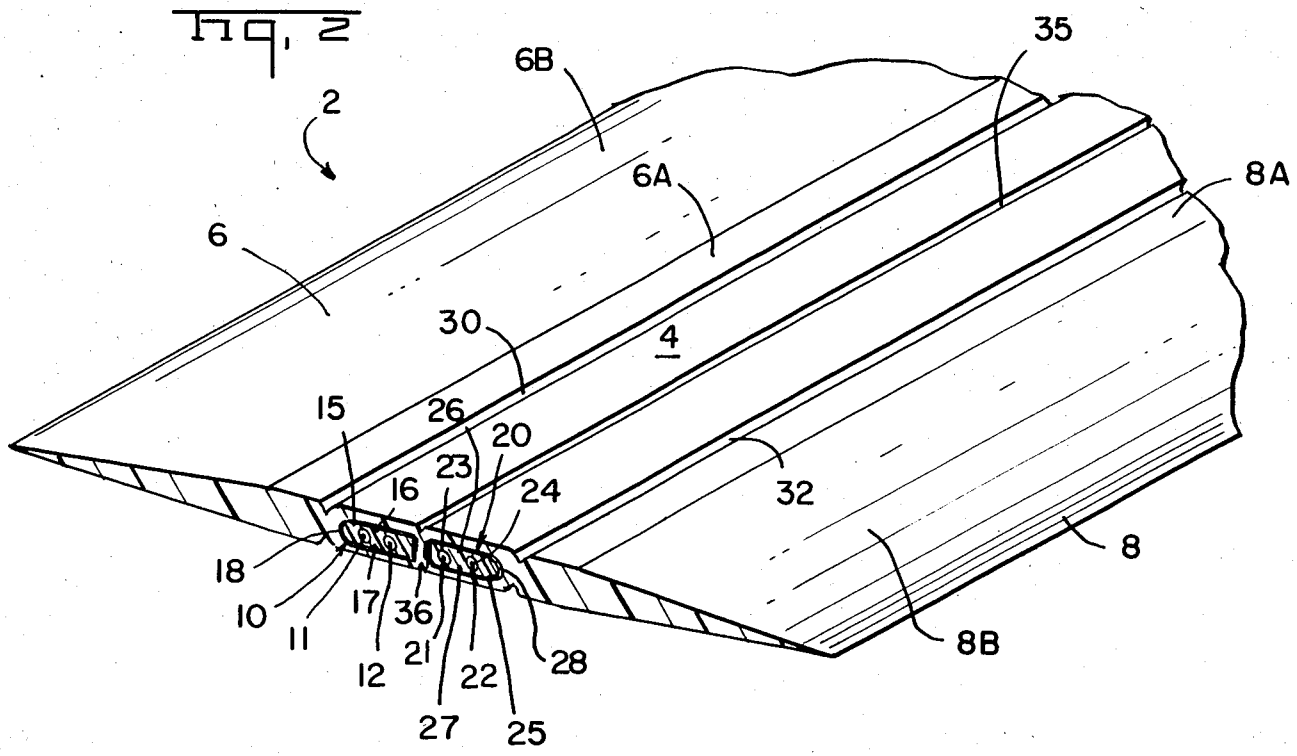
FIG. 2 is a perspective showing of a flat high performance cable to be stripped in accordance with the present invention.

The cross-sectional configuration shown in FIG. 2 demonstrates the relative positioning of four wire conductors 11, 12, 21 and 22 in a flat cable assembly 2. Each of the conductors 11, 12, 21 and 22 employed in the preferred embodiment of this invention comprises a conventional round wire conductor. Conductors 11 and 12 comprise one associated pair of conductors while conductors 21 and 22 comprise a similar pair of associated conductors. Although each of the conductors 11, 12, 21 and 22 is positioned in the same plane, thus facilitating the low profile necessary for use in undercarpet installations, the two conductor pairs are nevertheless electrically balanced. Both of the conductor pairs are embedded in an outer insulating body 4 which comprises the central longitudinally extending portion or region of the cable 2. Similarly-shaped wings or ramps 6 and 8 are bonded longitudinally along the opposite sides of the central body 4. Each of the wings 6 and 8 comprises an inclined surface to provide a smooth transition laterally of the axis of the cable, thus eliminating any sharp bump when the cable is positioned beneath a carpet. In the preferred embodiment of this invention, the insulating ramps 6 and 8 are formed from the same material as the insulating material which forms insulating body 4. Wings 6 and 8 are joined to body 4 along weakened longitudinally extending sections 30 and 32. In the preferred embodiment of this invention, the insulating material forming the body 4 and the insulating material forming wings 6 and 8 comprises an extruded insulating material having generally the same composition. A conventional polymer such as polyvinyl chloride, PVC, insulation comprises one material suitable for use in the jacket or body 4 in the wings 6 and 8.

The surfaces or faces of the opposed central regions of the cable are parallel to each other. A continuation of such parallelism extends to a limited degree into the wings of the cable. This extending of the parallelism into the wings provides for an extended thicker, horizontal section of the cable between the tapered regions of the wings when the cable is placed on the floor beneath a carpet. This design has been found to further distribute the forces from the carpet through the cable to the floor uniformly and reduce the external forces which would otherwise detrimentally act upon the wires and shield within the cable. As can be seen in FIG. 2, the transverse profile of the cable is low, and it is symmetric about both its central horizontal plane and its central vertical plane so that it may be employed with either face up reducing the chance for operator error during installation.

The opposed faces of the central region of the body are essentially flat and are as thin as possible consistent with known fabrication techniques while allowing for the high electrical performance of the cable. In the preferred embodiments of the invention this greatest thickness does not exceed from about 70 mils to about 80 mils. The width of the cable should be of such a dimension so that when employed under a carpet it will allow a smooth transition from the floor to the center of the cable and then thereacross. The presence of the cable should not be discernible. A preferred dimension for the width of the cable has been found to be about 2.000 inches. Such dimension will allow the above described smooth transition but will not enlarge the taper of the wings to the extent of being wasteful of material constituting their body.

Each shielded cable pair is separately embedded within the insulating body 4. As shown in FIG. 2, the conductors 21 and 22 forming one pair 20 of associated conductors are surrounded or embedded within a separate insulating core 25 which is, in turn, embedded within the body 4 of cable 2. Each conductor 21 and 22 is, however, surrounded by a first insulation 23 and 24 respectively which comprises a foam-type insulation having a relatively low dielectric constant. A polymeric, foamable insulation such as polypropylene or polyethylene, or any like material which can be fabricated with a large percentage of air trapped within the material, comprises a suitable dielectric material for use around the conductors in areas of relatively high dielectric field.

The cylinders of insulation 23 and 24 for the conductors are preferably extruded around the conductors. The extrusion material is preferably polyethylene resin with a predetermined percentage of a foaming agent blended with the polyethylene to be heated and extruded. It is the foaming agent which forms the air within the extruded product when subjected to heat and pressure. In accordance with known extrusion techniques, the materials, their compositions and proportions, the heat and speed of extrusion, the post-extrusion quenching, etc., are all carefully selected so as to form the insulation around the wire to exact dimensional tolerances and as a closed cell foam with about 40 to about 60 percent air by volume. It has been found that the maximum amount of air within the dielectric will improve the electrical performance of the system. However, excess air beyond the range as identified herein may degrade the dimensional stability and integrity of the foam.

Following the fabrication of the insulation surrounding the conductors, and prior to the performing of additional processing steps thereon, the individual insulating wires are preferable striped or otherwise marked with discrete, visually identifiable indicia 34 such as a color coding. Indicia, such as a helical color coded stripe along the length of the insulator on its exterior surface allows for visual differentiation of the various wires of the cable as during termination and coupling of the cable wires to an electrical component such as a connector. In this manner, when the final cable is stripped in association with a termination process, the proper wires of the cable may be coupled with the proper element of the connector or the like.

These foam covered conductors may then be embedded within an insulating material 25, as by extrusion, which completely surrounds the foam insulation 23 and 24 in the immediate vicinity of the conductors. The insulating material 25 need not have as low a dielectric constant as the foam insulation 23 and 24, since the insulating material 25 is located in areas of relatively lower electric fields. The insulating material 25 must, however, be suitable for imparting dimensional stability and integrity to conductors 21 and 22 as well as to their surrounding insulation 23 and 24. In fact, in this invention the dielectric material 25 holds the conductors 21 and 22 in a parallel configuration along precisely spaced surfaces, edges and center lines with respect to the cable and with respect to each other. The insulating material forming the core 25 also comprises a material having greater strength when subjected to compressive forces than the foam type insulation 23 and 24 surrounding conductors 21 and 22. A material suitable for forming core 25 is preferably a conventional flexible polyvinyl chloride, PVC, which can be extruded around the foam insulation 23 and 24 surrounding conductors 21 and 22. It is desirable that the foam type insulation 23 and 24 not adhere to the extruded insulating material forming the core 25 to facilitate separation of the conductors from the core 25 for conventional termination into an adaptor and connector.

Longitudinally extending notches 26 and 27 are defined along the upper and lower surfaces of the core 25. These notches, which can be conveniently formed as part of the extrusion process through the appropriate design of the die are located in areas of relatively low dielectric field and define a weakened section of insulating core 25 to permit separation of conductors 21 and 22 for termination purposes. Formed into the upper and lower surfaces of the body 4 are central notches 35 and 36 extending the length of the core along the centerline. Similar to the notches 26 and 27 in the core 25, central notches 35 and 36 are formed during the cooling process following the extrusion since a greater quantity of shrinkable PVC is located in the body 4 between the upper and lower notches as compared with the quantity of insulator immediately to either side thereof.

The electrical performance of each pair of conductors is greatly enhanced by the use of EMI shields 18 and 28 encircling the cores 15 and 25 of the conductors within each conductor pair 10 and 20. As shown in FIG. 3, and EMI shield 28 can be positioned in partially encircling relationship to conductors 21 and 22 within insulating core 25. The ends 28A and 28B of EMI shield extend beyond the lateral edge of core 25 during fabrication of the cable.

An annealed metallic foil is employed as the EMI shields 18 and 28. For example, an annealed copper foil having about a 2 mil thickness is suitable for use as an EMI shield in the preferred embodiment of the invention.

A final outer insulation is then extruded over the EMI shields 18 and 25 to embed both conductor pair cores in a single structure. The insulation forming the outer layer of body 4 is preferably conventional polyvinyl chloride and is extruded around the conductor pair cores. Wings 6 and 8 also comprise an extruded polyvinyl chloride and weakened sections 30 and 32 can be formed during this final extrusion.

A flattened central portion extends across the central region of the cable and also includes a straight portion 6A and 8A constituting a minor extent of both wings. Tapered sections 6B and 8B are thus created by the wings across the majority of their lateral extents. When employed under a normal carpet of the type found in most offices today the deflection to the carpet is barely discernible to someone when walking thereacross or when rolling the wheels of a table or chair over the cable. It has also been found that the cable will not be damaged nor will its performance be impaired by normal traffic of this type, even from the very high pressure of a heel of a woman's high heeled shoes. No problem would even arise if a filing cabinet or desk leg were to rest permanently upon the cable. It has been found that the PVC matrix of the cable yields slightly under heavy but normal office environmental loads. The cross-sectional configuration of this material, however, tends to distribute any such downward compressive forces through the cable to the floor and around the signal wires and their insulation.

Not only is this cable suitable for use in applications in which high electrical performance is required, this cable is also easily adaptable to termination of the separate conductors to an electrical connector at the end of the cable as by the methods and apparatus as disclosed herein.

Figure 1:
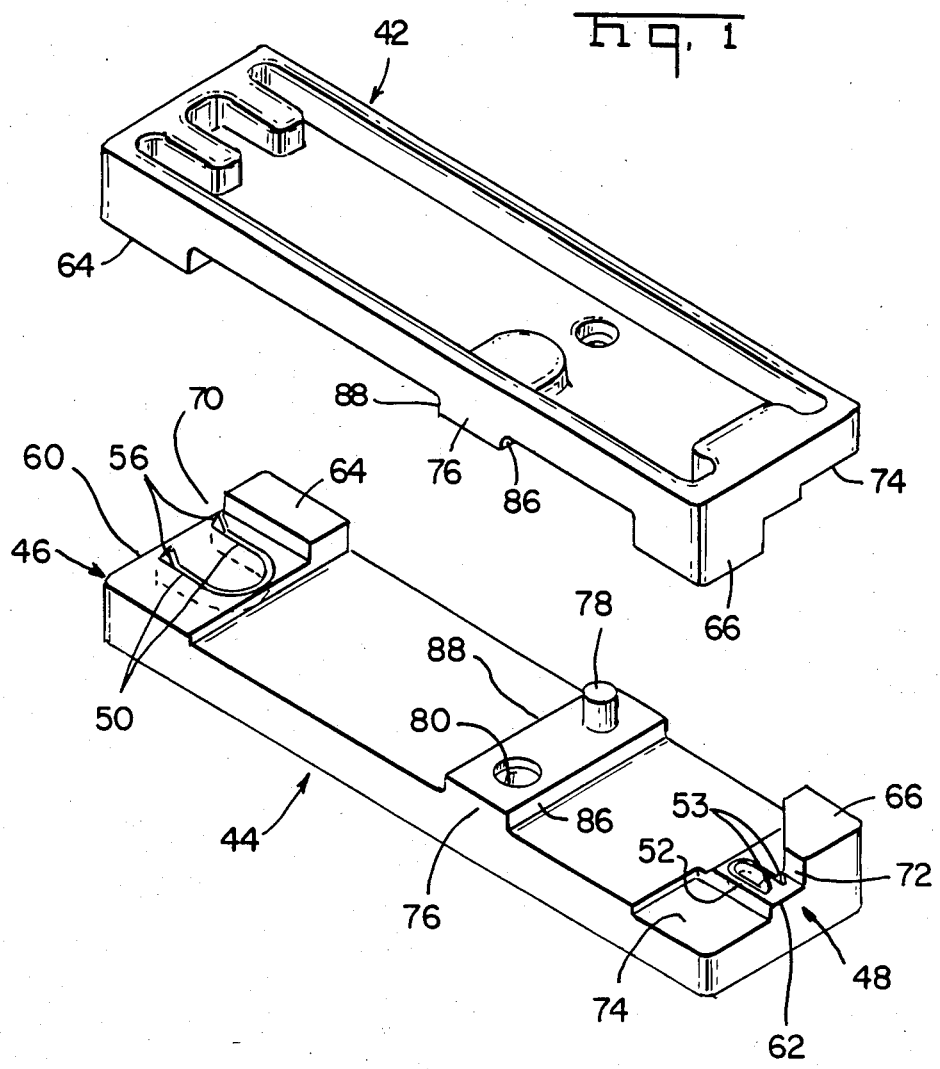
FIGS. 1 and 1A are perspective showing of hand-held stripping tools which may be employed in carrying out the methods of the present invention.
Figure 1A:
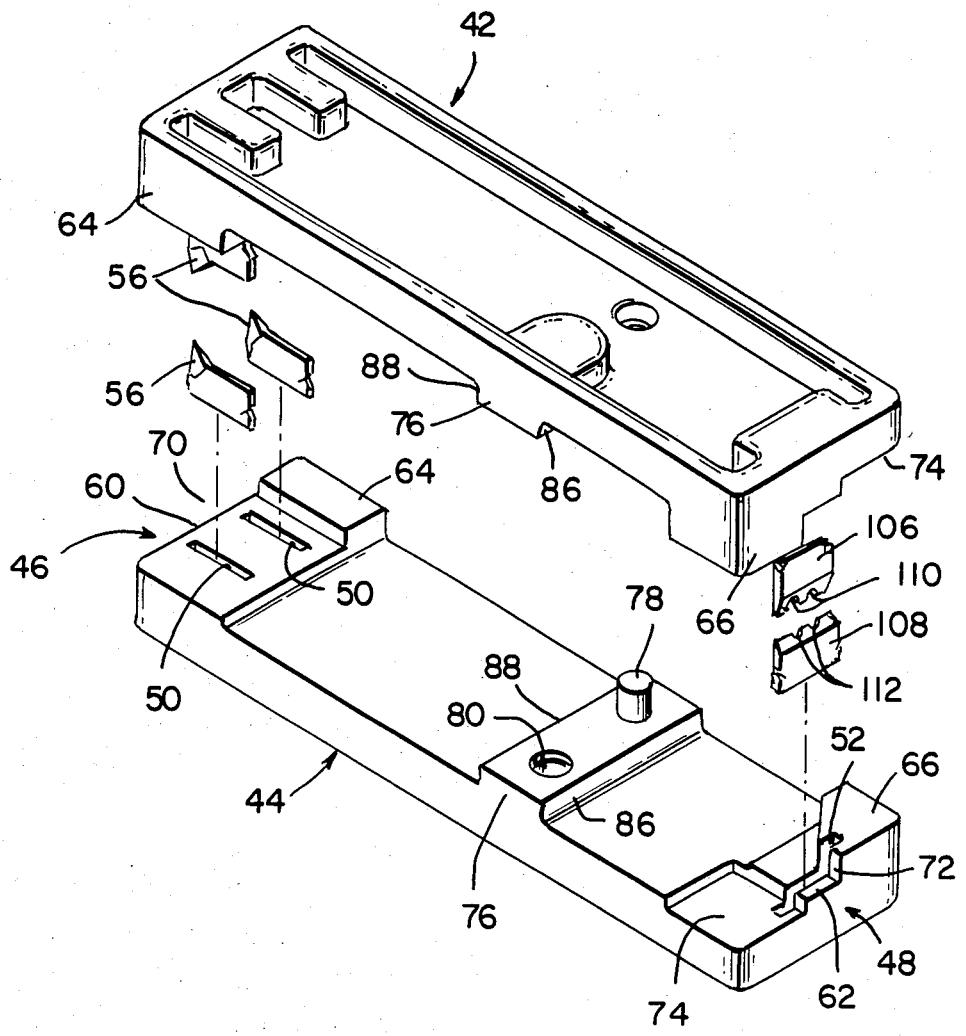

Shown in FIGS. 3 through 12 are the sequential steps used to strip an end of the above described cable, shown in FIG. 2, prior to the termination process. Before describing the steps in detail, the stripping tools as shown in FIGS. 1 and 1A employed in performing such steps will be described in detail.

The stripping tool is formed of two halves 42 and 44 molded or otherwise shaped of a rigid material such as any known hard plastic or the like. The first or upper half 42 and the second or lower half 44 are adhered together in permanent fashion and provided with cutting blades as will be more fully described later. The halves of the tool as well as the halves of the cable are of a similar design, and it does not matter which side is positioned upwardly during utilization of the tool.

Each tool half includes a first end 46 and a second end 48. At each tool end, knife edges 56 and 58 are received in both the upper and lower halves in slots 50 and 52 knife edges 56 and 58. The knife edges 56 at the first end have their points in alignment with each other and move toward each other into operative engagement when closed together for slitting. These knife edges are laterally spaced a distance corresponding to exterior portions of the two EMI shields. Similarly, the second end is also provided with four opposing longitudinal slitting knife edges 58.

Each tool half has at each end, an upstanding block 60 and 62. On one edge of each block is an upstanding enlarged segment 64 and 66 projecting toward the opposing tool half. The blocks and segments together form a first aperture 70 at the first end and a second aperture 72 at the second end. The second end of the tool is formed slightly differently than the first end in that the edges of the blocks remote from the enlarged segments include depressions 74 for the receipt of the opposing enlarged segments. The edges of the depressions and the enlarged segments are in sliding contact one with another to assist in maintaining the alignment of the tool halves during use.

The first aperture 70 is of such size as to receive a central region 4 of a cable. The knife edges within the first aperture are normally spaced so that a central region of a cable may be inserted without cutting or slitting its exterior surface. The second aperture 72 is of such size as to receive a second insulator of a cable. The knife edges within the second aperture are normally spaced so that a second insulator 25 of a cable may be inserted without cutting or slitting its exterior surface. Central supports 76 extend transverse of the tool halves. Each is provided with a male and female positioning member 78 and 80 so that the cutter segments may be mated for the accurate orientation of the blades. The height of the central blocks are such so that when they are mated and permanently adhered together as through gluing, gaps 82 will be present at the first and second ends. These gaps normally enlarge the apertures beyond their operative cutting orientations to allow the unimpeded entry of the cable parts to be cut. Because of the design of the stripping tool and the nature of the plastic selected for the fabrication of the tool each end may be closed through the pressure applied to the fingers of the user to move the blades into operative cutting relationship and to sequentially effect the desired slicing or cutting. The central supports together form abutment surfaces 86 and 88 to limit the depth of penetration of the cable parts to be inserted and cut. As can be seen in FIG. 1, the cutting tool is formed with its central support closer to the second end than the first end. The distance that the cable penetrates the first end might be slightly greater than two inches while the distance in the second end might just be slightly greater than one inch. Such will yield adequate distances for presenting a sufficient length of wire and EMI shield for coupling the stripped cable end to an appropriate adaptor and connector.

Returning now to the sequential steps, FIG. 3 shows wings 6 and 8 peeled back and cut away adjacent the end of the cable to be stripped and terminated. Such stripping is done along the preformed weakened lines 30 and 32, first to one wing and then the other. Such tearing back is normally done to a minimum length of 3 inches from the end of the cable being stripped. When cutting off the excess wing material, it is normally done at a rearwardly directed angle 90 to simplify further operations on the central region of the cable. A scissors is normally employed for this function with the pointed ends of the scissors pointing away from the central segment of the cable to preclude inadvertent cutting of the second insulator and the wires.

Figure 4:
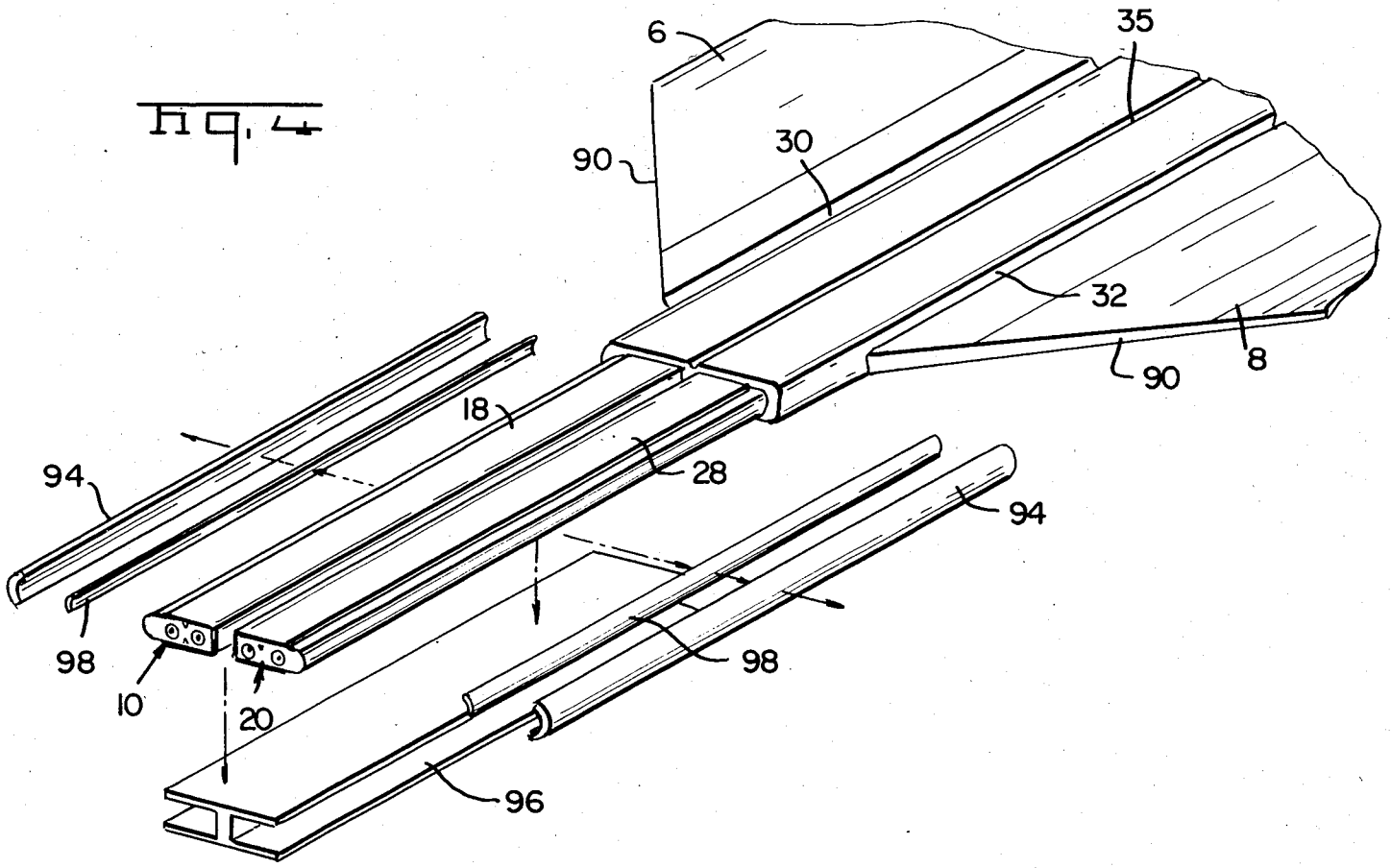
Figure 5:
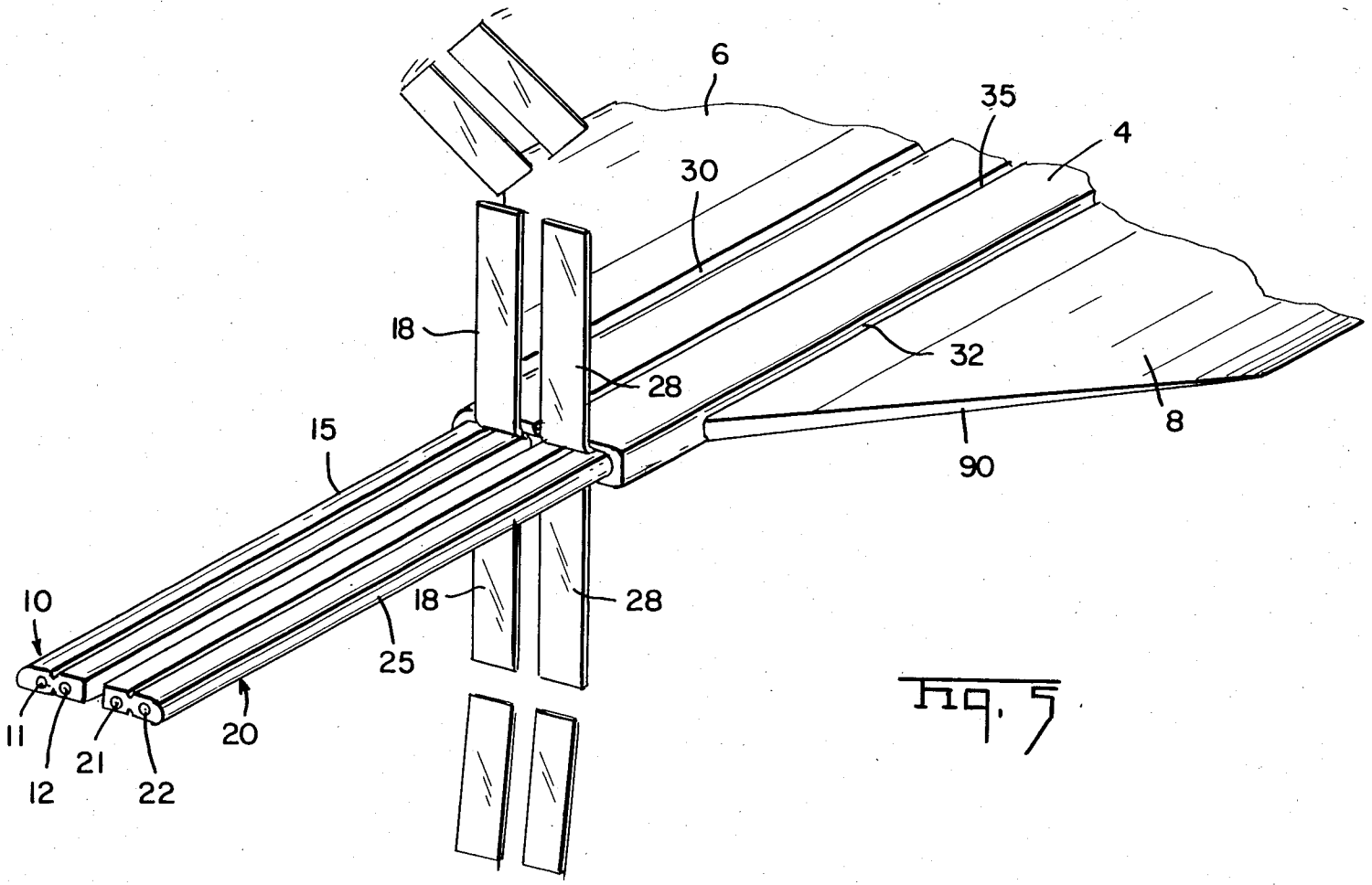

Four parallel slits 92 are then made into the length of the central region of the cable. The slits each extend about half way into the cable and slit the EMI shield and first insulator but do not cut the second insulator. Since the overlapping ends of the individual EMI shields are unattached when secured around each insulated conductor pair, the slit 92, which is offset from the center line of each conductor pair, defines a separate strip of foil, above and below the plane of the conductors. FIG. 4 shows the scrap 94 from the first insulator at the edges, and the remnant at the center having an H shape in cross section 96. Also shown is the scrap EMI shield segments 98 from the edges. These scrap pieces are transversely cut from the remainder of the body at a length from the end of the cable of about 2 inches. The remaining flat sections of foil from the EMI shield are then turned away from the longitudinal axis and cut transversely at about their midspan. The sections of the foil are thus prepared to be deployed for coupling to a connector.

Figure 6:
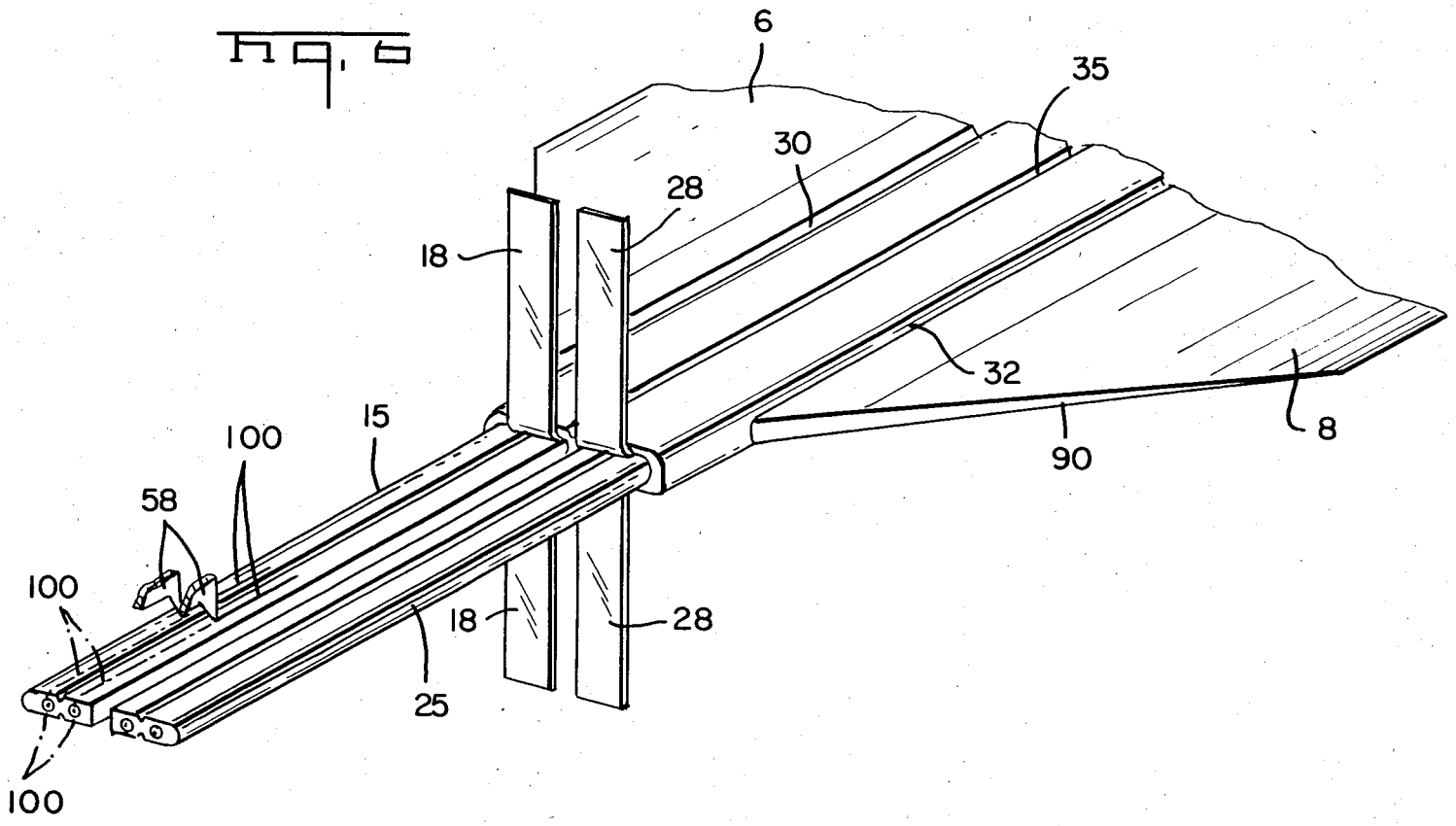
Figure 6A:
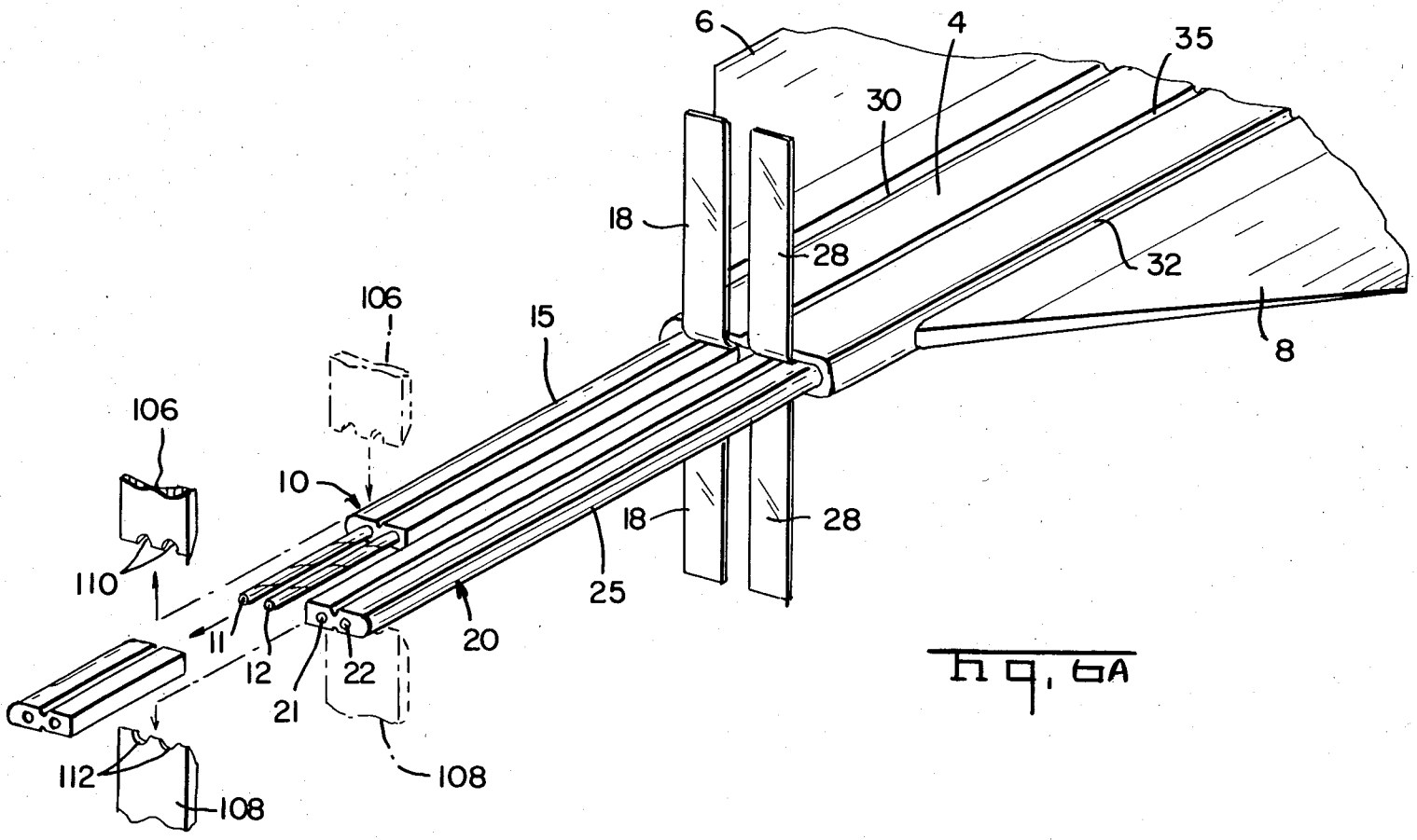
Figure 7:
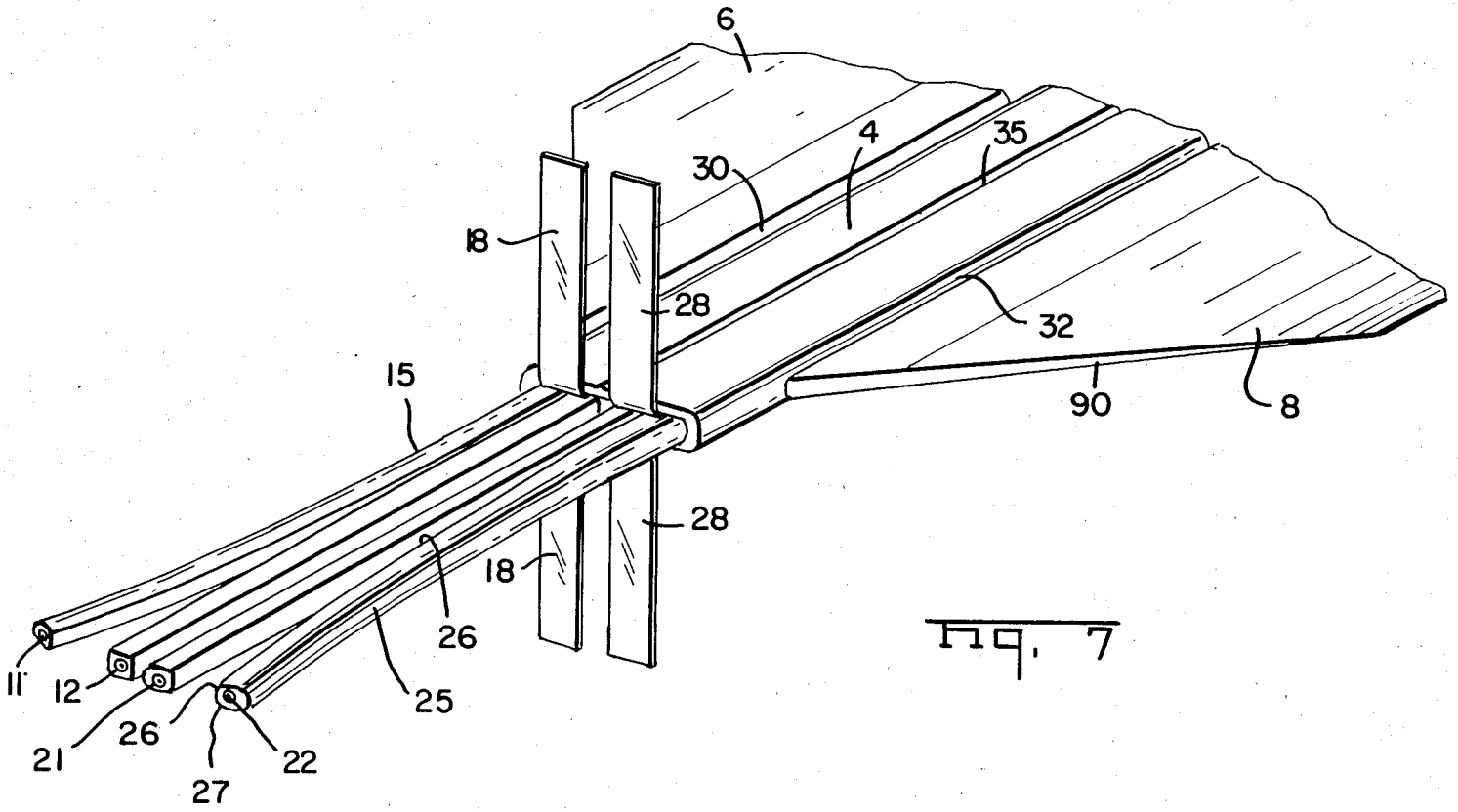
Figure 8:
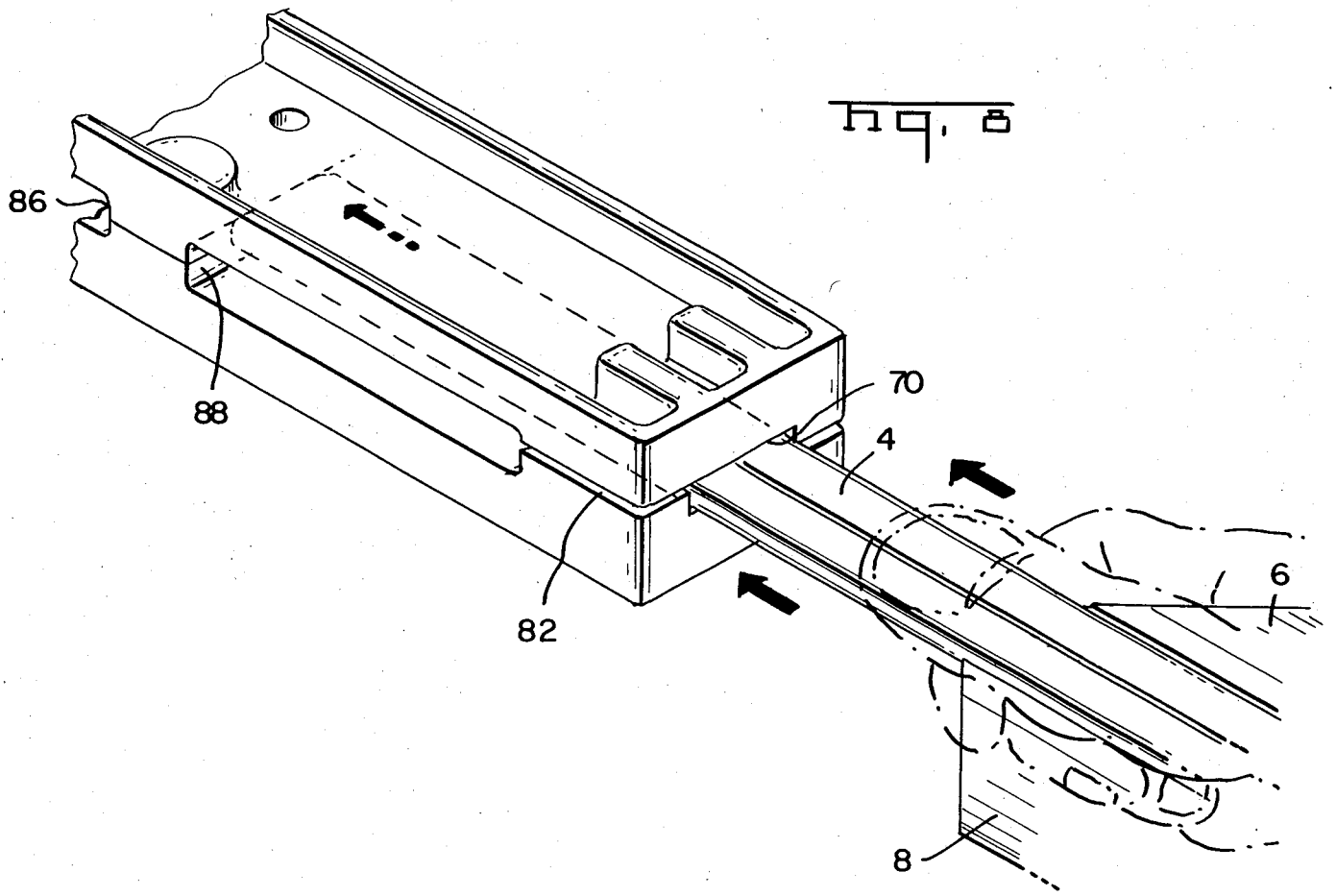
FIGS. 8 through 11 are perspective showings of the primary embodiment of the slitting tool performing the primary method embodiment on the cable as shown in FIG. 2.
Figure 9:
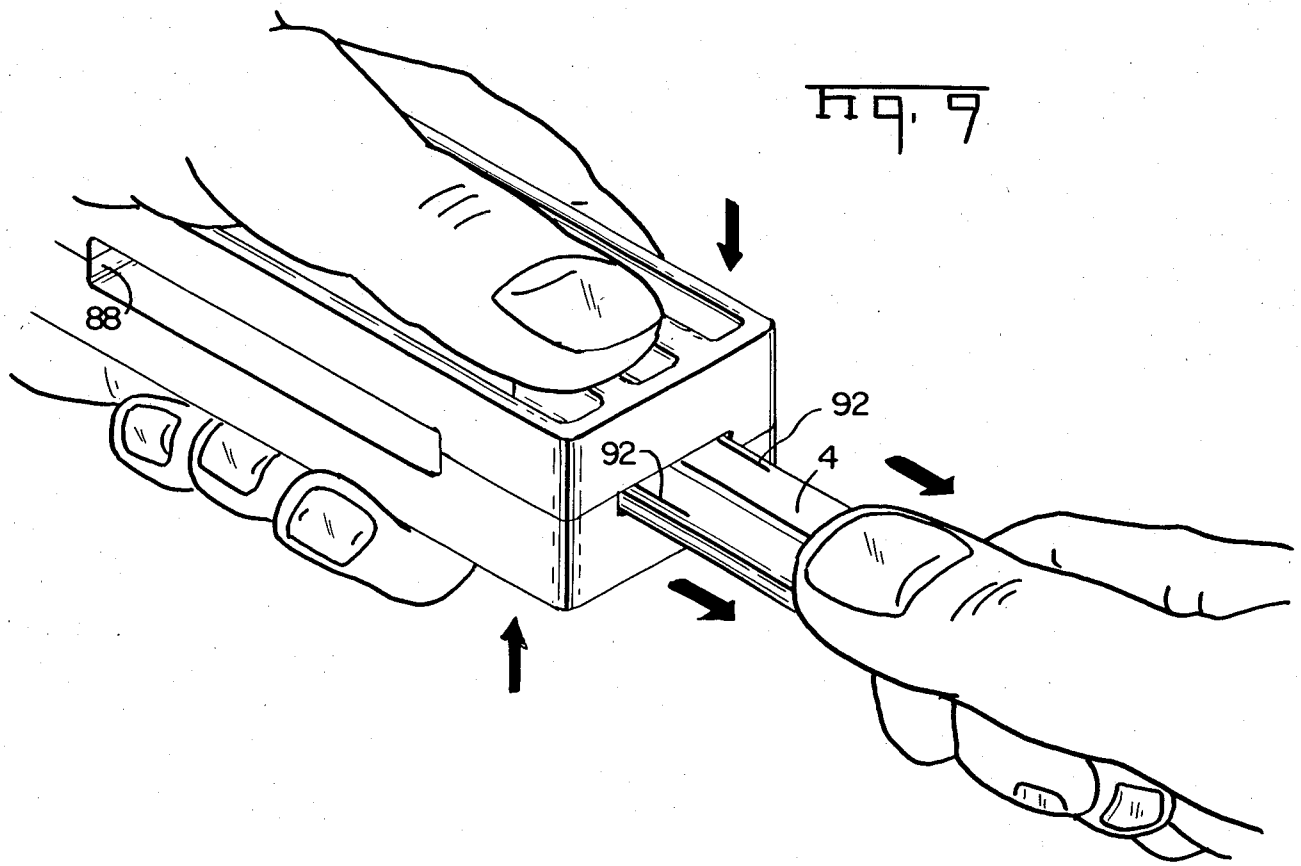

Four additional parallel slits 100 are then made into the length of one of the second insulators of the cable. The slits 100 each extend about half way into the cable and cut the second insulator but do not cut the first insulator. FIG. 6 shows this step with the slits 100 extending through the second insulator adjacent the lateral edges, but out of contact with, the first insulator. The slits are formed with the application of longitudinal movement between the second insulator and the knife edges. The scrap pieces from the second insulator are transversely cut from the remainder of the body at a length from the end of the cable of about 1 inch. These operational steps on a second insulator are then performed upon the other second insulator.

Figure 7:
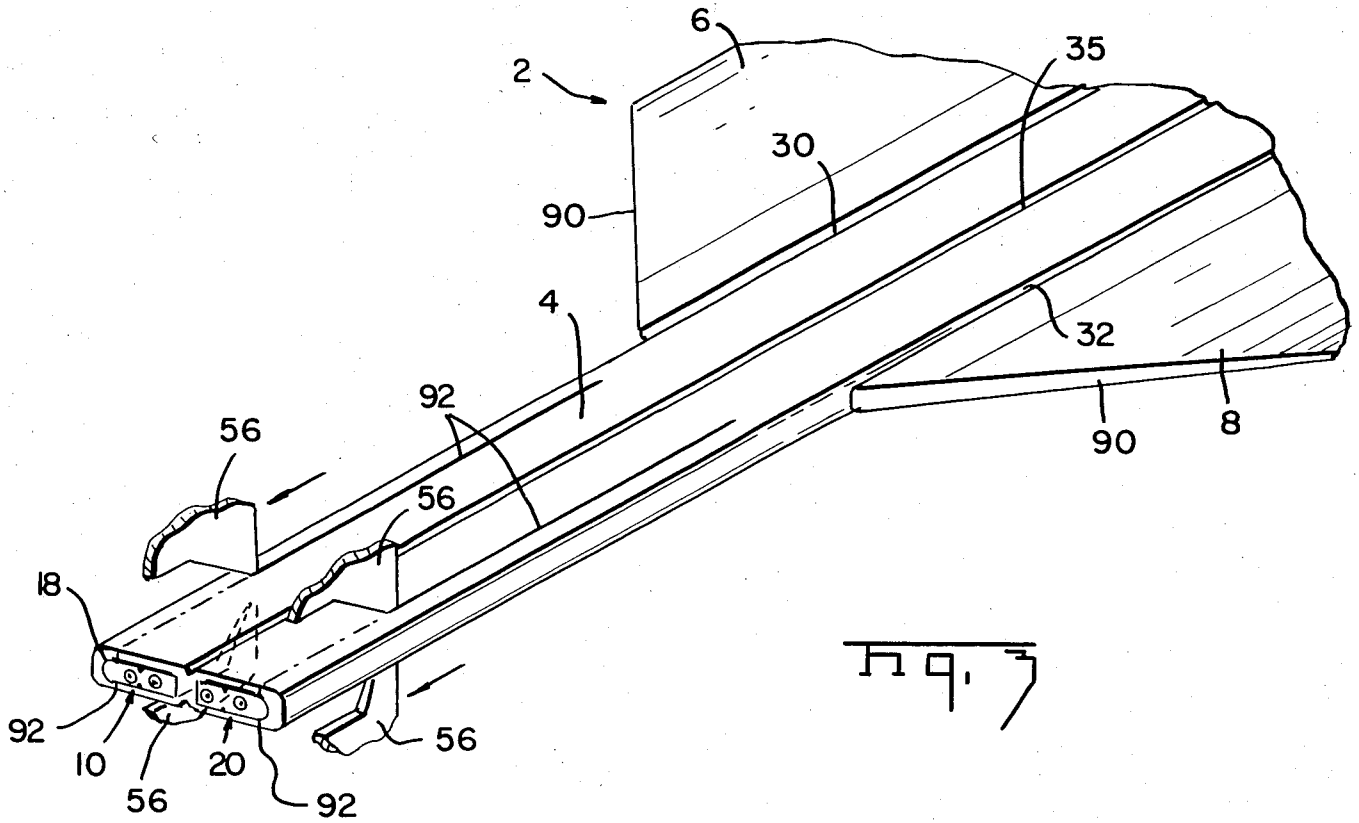
FIGS. 6 and 7 are perspective showings of the cable of FIG. 2 during the stripping or preparation of the intermediate or second insulator from the cable, FIGS. 6 and 6A showing alternate embodiments of a cutting tool, and FIG. 7 showing a method not requiring a cutting tool.

FIG. 7 illustrates an alternative to the above described steps of cutting the second insulator. This alternative step merely includes the tearing of the second insulator longitudinally about 1 inch from the end of the cable so that the halves of the second insulators may be later utilized. Longitudinal central weakening lines 26 and 27 along each second insulator allows for an operator to carry out this tearing step by hand.

FIGS. 8 through 11 illustrate an operator utilizing the stripping tool as described above in association with the showing of FIG. 1. The method is carried out by tearing back the wings away from the central region and then cutting them off. An operator can then insert the wingless central region of the cable into the first end of the cutting tool. The insertion is done until the free end of the cable contacts or abuts the abutment surface formed by the central supports of the cutting tool. At this time, the operator applies pressure with his hand to the first end of the cutting tool to close the gap and cause the blades of the two segments of the cutting tool to move towards each other and penetrate the second insulator and EMI shield adjacent their exterior edges. The operator maintains this pressure with one hand and linearly withdraws the cable from the cutting tool. Note the arrows of FIG. 9.

Figure 10:
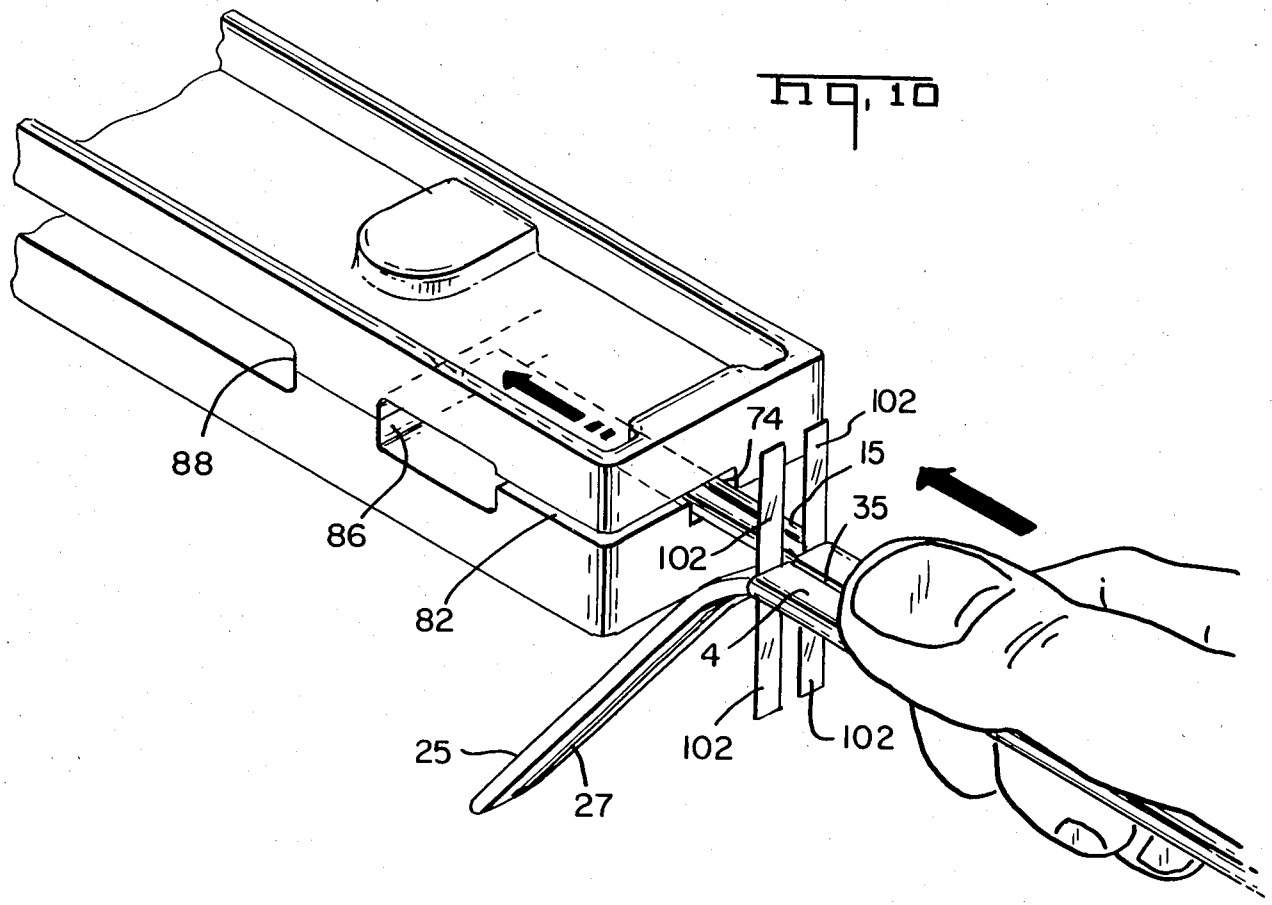

As shown in FIG. 10, the operator has peeled back the scrap edge segments of the EMI shield and second insulator as well as the central H-shaped segment of second insulator. These segments of extraneous scrap material may then be bent upwardly and cut adjacent their point of connection to the unslit part of the central region of the central portion of the cable. The remaining strips 102 of the shield may then be bent essentially perpendicular to the remaining cable sections and snipped about mid span. Such remaining sections of EMI shield are utilized in grounding the cable end to an adapter and connector.

Figure 11:
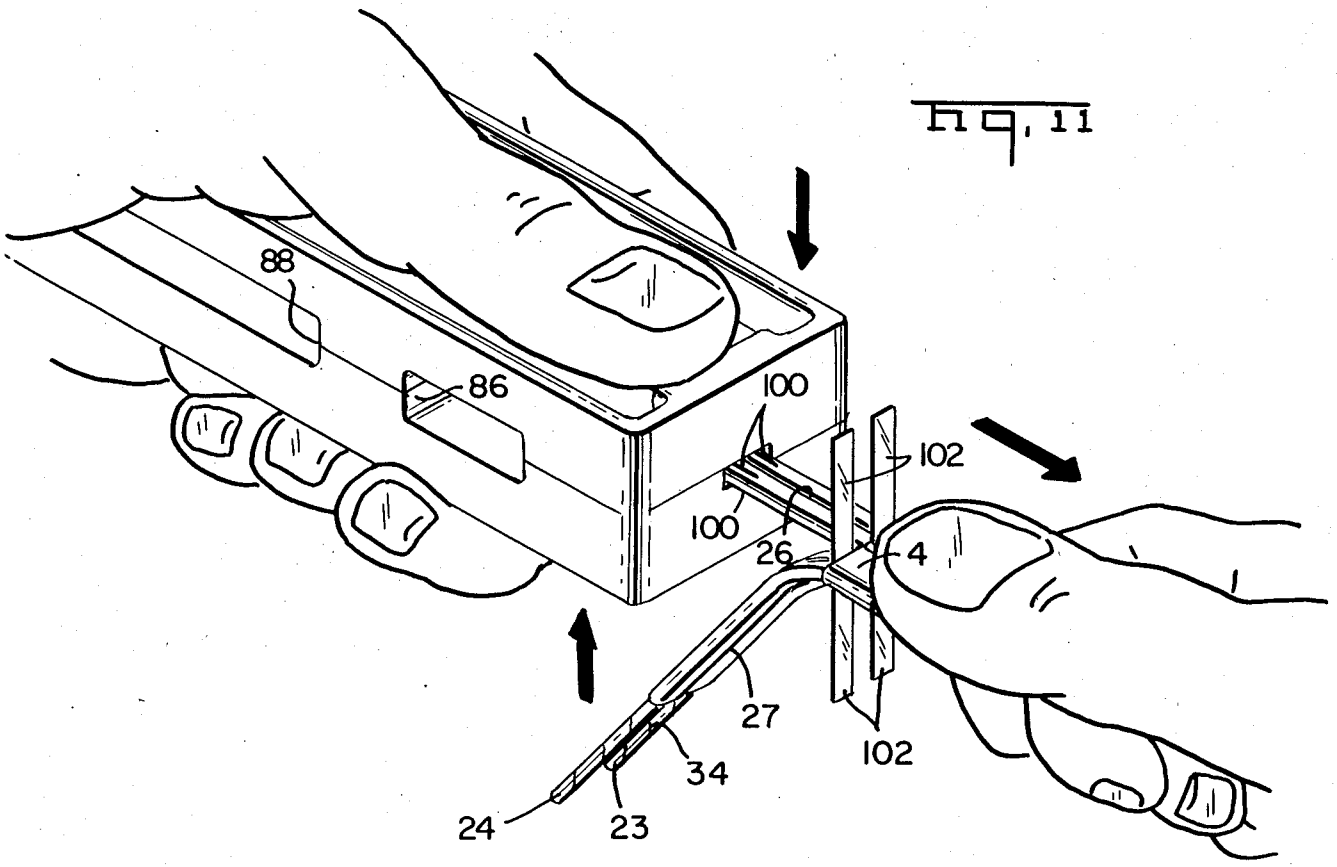

Each pair of conductive wires encased in its closed cell foam insulation is then inserted into the second end 48 of the cutting tool. The insertion is done linearly until it contacts or abuts with the second abutment surface 86 of the central supports of the cutting tool. Pressure is then applied as shown in FIG. 11 to close the second gap to cut the second insulator but not the first or foam insulation. The operator maintains the pressure on the second end of the knife edge tool and withdraws the cable portion to expose the indicia ladened insulators on the wires. Any material from the second insulator still on the insulation may be peeled back and transversely cut off adjacent their bases.

As an alternative to the step of removing the second insulator by slitting, chopping, an alternate form of cutting, may be utilized. FIG. 1A shows the hand-held stripping tool but different knife edges are utilized. A coacting pair of transversely positioned knife edges 106 and 108 is positioned, one above and one below the second aperture, in the halves of the tool. The knife edges are normally located a sufficient distance from each other to allow the entry of a predetermined length of a second insulator into the second end without cutting the second insulator. The knife edges are movable with the tool halves into operative chopping contact with each other whereby upon moving the knife edges into such operative association with each other they may cut the second insulator but not the first insulator. This pair of transverse blades, one above and one below the second aperture, are provided with pairs of semicircular cut out sections 110 and 112, of such size and position to preclude the cutting of the first insulator during the chopping.

It should be readily understood that the above described stripping methods and apparatus or tools are readily adapted to a continuous and automatic cycle of operation as through the use of a robot and other associated automated machinery. It should be further understood that the above described method could readily be carried out by an operator without the use of the apparatus or tools comprising the preferred embodiment of the invention. Although the invention has been described in terms of two embodiments and additional extensions of this invention have been discussed, it will be appreciated that the invention is not limited to the precise embodiments disclosed or discussed since other embodiments will be readily apparent to those skilled in the art.

What is claimed is:

1. A method of preparing the ends of a flat shielded electrical cable for connection to grounded electrical components, the cable having a shield surrounding a plurality of conductors, the cable having insulation surrounding the shield and between the shield and the conductors, the method comprising the steps of:

axially slitting the insulation surrounding the shield and the shield along slit lines laterally spaced from the conductors, above and below the conductors to form separate shield strips above and below the conductors extending axially inward from an end of the cable; and deploying the shield strips for access to the conductors, whereby the conductors can be attached to electrical components and the shield strips can be grounded.

2. The method as set forth in claim 1 comprising the further step of axially separating the conductors for individual attachment to electrical components.

3. The method as set forth in claim 2 comprising the further steps of attaching the conductors to terminals in an electrical connector and attaching the separate strips to a connector shield.

4. A method of stripping insulation from an electrical signal transmitting cable having at least one pair of associated wires, a first insulator means surrounding each wire along its length, a second insulator means surrounding each associated pair of wires, an EMI shield means surrounding each second insulator means, and a third insulator means constituting the cable body surrounding the EMI shield means, said method comprising the steps of:

axially slitting the cable through the edges of the third insulator means and EMI shield, but not the second or first insulator means, to a predetermined length from the end, and folding back the third insulator means and EMI shield means to expose a second insulator means.

5. The method as set forth in claim 4 and further including the step of tearing a second insulator along a longitudinal ridge to separate the two first insulator means and their surrounded wires.

6. The method as set forth in claim 4 and further including the step of chopping a second insulating means at a third predetermined length from the end of the cable less than the second predetermined length without cutting the first insulating means.

7. The method as set forth in claim 4 and further including the step of slitting the second insulating means at a third predetermined length from the end of the cable less than the second predetermined length without cutting the first insulating means.

8. The method as set forth in claim 4 wherein said cable body has a longitudinal central region and marginal wings, the method including the step of peeling back and cutting off the wings to a distance from the ends of said cable greater than the predetermined length before axially slitting the cable.

9. A method of stripping insulation from a high frequency electrical signal transmitting cable having at least one pair of associated wires, a first insulator means surrounding each wire along its length, a second insulator means surrounding each associated pair of wires, an EMI shield means surrounding each second insulator means, and a third insulator means constituting the cable body surrounding the EMI shield means, said body having a longitudinal central region and marginal wings, said method comprising the steps of:

tearing back the wings from the central region a first predetermined distance from the end of the cable, inserting the central region of the cable into a first end of a stripping tool through a first aperture to a second predetermined distance less than the first predetermined distance;

moving pairs of laterally spaced slitting knife edges above and below the first aperture into operative association with each other and into the exterior portions of the third insulator means and EMI shield means adjacent the exterior portions of the first insulator means;

extracting the central region of the cable to thereby slit the third insulator means and EMI shield means along their lengths;

inserting a second insulator means of the cable into a second aperture at the second end of a stripping tool to a third predetermined distance less than the second predetermined distance; and moving knife edge means above and below the second aperture into operative relationship into the second insulator means adjacent the first insulator means to cut the second insulator means but not the first insulator means.

10. The method as set forth in claim 9 wherein the last mentioned knife edge means are slitting knife edges which slit the second insulator means upon its extraction from the second aperture.

11. The method as set forth in claim 9 wherein the last mentioned knife edge means are transverse blades with cut outs corresponding to the size and location of the first insulator means to chop the second insulator means but not the first insulator means.

* * * * *